US012371284B2

(12) United States Patent
Nakata

(10) Patent No.: US 12,371,284 B2
(45) Date of Patent: Jul. 29, 2025

(54) MEDIUM FEEDING DEVICE, IMAGE RECORDING APPARATUS, AND IMAGE READING APPARATUS

(71) Applicant: SEIKO EPSON CORPORATION, Tokyo (JP)

(72) Inventor: Satoshi Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 17/823,875

(22) Filed: Aug. 31, 2022

(65) Prior Publication Data

US 2023/0067412 A1 Mar. 2, 2023

(30) Foreign Application Priority Data

Sep. 2, 2021 (JP) ..... 2021-143079

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2405/114* (2013.01); *B65H 2405/115* (2013.01); *B65H 2511/12* (2013.01)

(58) Field of Classification Search
CPC ..... B65H 1/04; B65H 3/0661; B65H 2405/11152; B65H 2405/11164; B65H 2405/114; B65H 2405/1144; B65H 2405/115; B65H 2407/21; B65H 2511/12
See application file for complete search history.

(56) References Cited

U.S. PATENT DOCUMENTS 5,346,197 A * 9/1994 Takano ..... B65H 1/04 271/9.05
9,796,541 B2 10/2017 Takahashi et al.
2004/0184022 A1* 9/2004 Kamiyama ..... B65H 1/04 355/75
2013/0056923 A1* 3/2013 Kuriki ..... H04N 1/00554 271/145
2016/0244284 A1 8/2016 Takahashi et al.
(Continued)

FOREIGN PATENT DOCUMENTS

JP 2016-155660 9/2016
JP 2018-087065 6/2018
JP 2021-024128 A 2/2021

*Primary Examiner* — Prasad V Gokhale
(74) *Attorney, Agent, or Firm* — WORKMAN NYDEGGER

(57) ABSTRACT

A medium feeding device for feeding a medium through a feed opening, the medium feeding device including: a stacked unit that extends to pass through the feed opening and on which a medium is stacked; a feeding unit that feeds a medium stacked on the stacked unit; a regulating unit that regulates a position of a medium stacked on the stacked unit, in width directions; and a cover that opens and closes relative to the feed opening, wherein the regulating unit includes a main regulating member movable in the width directions and attached to the stacked unit and a subordinate regulating member movable in the width directions and attached to the cover, a downstream end, in a feed direction, of the main regulating member is located downstream of the feed opening, and the main regulating member is linked to and cooperates with the subordinate regulating member.

19 Claims, 9 Drawing Sheets

(56) References Cited

U.S. PATENT DOCUMENTS

| | | | | |
|---|---|---|---|---|
| 2018/0170694 | A1* | 6/2018 | Takagi | B41J 13/0018 |
| 2019/0016163 | A1* | 1/2019 | Ito | B41J 23/02 |
| 2021/0024306 | A1* | 1/2021 | Shuto | B65H 1/04 |
| 2021/0037145 | A1 | 2/2021 | Fujiwara | |

* cited by examiner

MEDIUM FEEDING DEVICE, IMAGE RECORDING APPARATUS, AND IMAGE READING APPARATUS

The present application is based on, and claims priority from JP Application Serial Number 2021-143079, filed Sep. 2, 2021, the disclosure of which is hereby incorporated by reference herein in its entirety.

BACKGROUND

1. Technical Field

The present disclosure relates to a medium feeding device, an image recording apparatus, and an image reading apparatus.

2. Related Art

Described in JP-A-2021-24128 is a recording apparatus that feeds a medium through a feed opening. The described recording apparatus includes a stacked unit on which a medium is stacked, a feeding unit that feeds a medium, a regulating unit that regulates the position of a medium stacked on the stacked unit, and a cover that opens and closes relative to the feed opening. The regulating unit is located downstream of the feed opening. When the cover is open, the regulating unit is exposed. The regulating unit regulates the position of a medium stacked on the stacked unit, so that the inclination of the medium stacked on the stacked unit is reduced.

For the recording apparatus described in JP-A-2021-24128, a user needs to open the cover to operate the regulating unit. Therefore, it is troublesome for a user to operate the regulating unit.

SUMMARY

A medium feeding device that solves the above-described problem is a medium feeding device for feeding a medium through a feed opening, the medium feeding device including: a stacked unit that extends to pass through the feed opening and on which a medium is stacked; a feeding unit that feeds a medium stacked on the stacked unit; a regulating unit that regulates a position of a medium stacked on the stacked unit, in width directions; and a cover that opens and closes relative to the feed opening, wherein the regulating unit includes a main regulating member movable in the width directions and attached to the stacked unit and a subordinate regulating member movable in the width directions and attached to the cover, a downstream end, in a feed direction, of the main regulating member is located downstream of the feed opening, and the main regulating member is linked to and cooperates with the subordinate regulating member.

An image recording apparatus that solves the above-described problem includes: the above-described medium feeding device; and a recording unit that records an image on a medium stacked on the stacked unit.

An image reading apparatus that solves the above-described problem includes: the above-described medium feeding device; and a reading unit that reads an image on a medium stacked on the stacked unit.

DESCRIPTION OF EXEMPLARY EMBODIMENTS

Hereinafter, an embodiment of an image recording apparatus including a medium feeding device will be described with reference to the drawings. The image recording apparatus is, for example, an ink jet printer that records an image, such as characters or a photograph, by ejecting ink, which is an example of liquid, onto a medium, such as paper or fabric.

Figure 1:
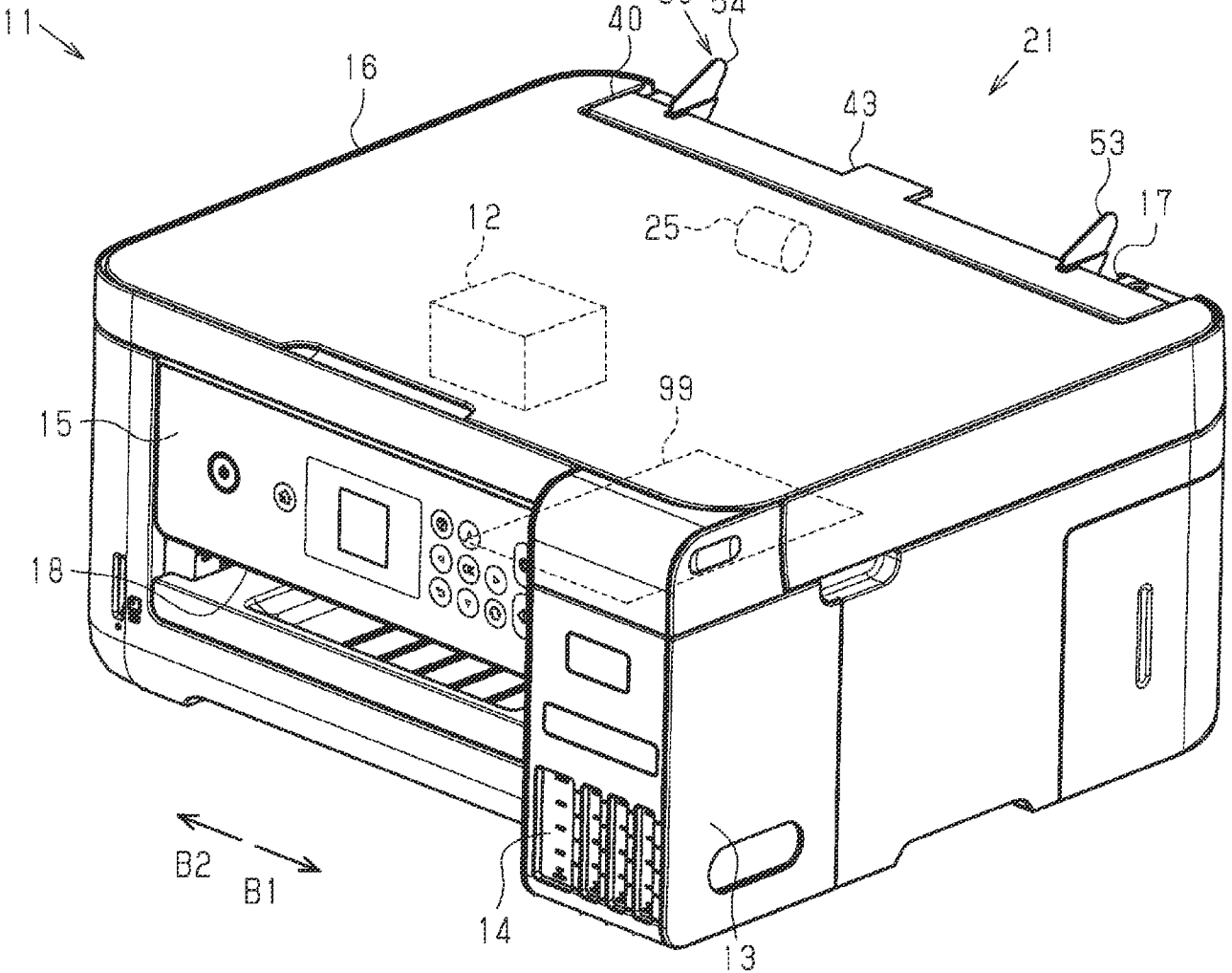
FIG. 1 is a perspective view illustrating an embodiment of an image recording apparatus including a medium feeding device.

As illustrated in FIG. 1, an image recording apparatus 11 includes a recording unit 12. The recording unit 12 is configured to record an image on a medium 99. The recording unit 12 is, for example, a head including one or a plurality of nozzles. The recording unit 12 ejects liquid onto a medium 99 from the nozzle(s). The recording unit 12 may be configured to record an image by spraying powder onto a medium 99.

The recording unit 12 is configured to, for example, scan a medium 99. That is to say, the image recording apparatus 11 is a serial printer. The recording unit 12 may be configured to be able to eject liquid across the width of a medium 99 at once. In this case, the image recording apparatus 11 is a line printer.

The image recording apparatus 11 includes a loaded unit 13. The loaded unit 13 is configured such that one or a plurality of liquid containers 14 is loaded in the loaded unit 13. The liquid container 14 is configured to contain a liquid. The liquid container 14 is, for example, an ink cartridge, an ink tank, or the like. The liquid container 14 is loaded in the loaded unit 13 to supply the liquid from the liquid container 14 to the recording unit 12.

The image recording apparatus 11 includes an operation panel 15. The operation panel 15 includes, for example, buttons, a touch panel, and the like. A user operates the image recording apparatus 11 with the operation panel 15.

The image recording apparatus 11 includes a housing 16. The housing 16 accommodates the recording unit 12. The housing 16 accommodates the loaded unit 13 in addition to the recording unit 12. The operation panel 15 is attached to the front surface of the housing 16.

The housing 16 has a feed opening 17. A medium 99 is fed into the housing 16 through the feed opening 17. That is to say, the image recording apparatus 11 feeds a medium 99 through the feed opening 17. The housing 16 has a discharge opening 18. The housing 16 has the discharge opening 18 in, for example, the front surface of the housing 16. A medium 99 is discharged to the outside of the housing 16 through the discharge opening 18. That is to say, the image recording apparatus 11 discharges a medium 99 through the discharge opening 18.

The image recording apparatus 11 includes a medium feeding device 21. In the image recording apparatus 11, the medium feeding device 21 feeds a medium 99. That is to say, the medium feeding device 21 feeds a medium 99 through the feed opening 17.

The medium feeding device 21 includes a feeding unit 25. The feeding unit 25 is accommodated in the housing 16. The feeding unit 25 is configured to feed a medium 99. The feeding unit 25 is, for example, a roller. The feeding unit 25 rotates to feed a medium 99 through the feed opening 17.

Figure 2:
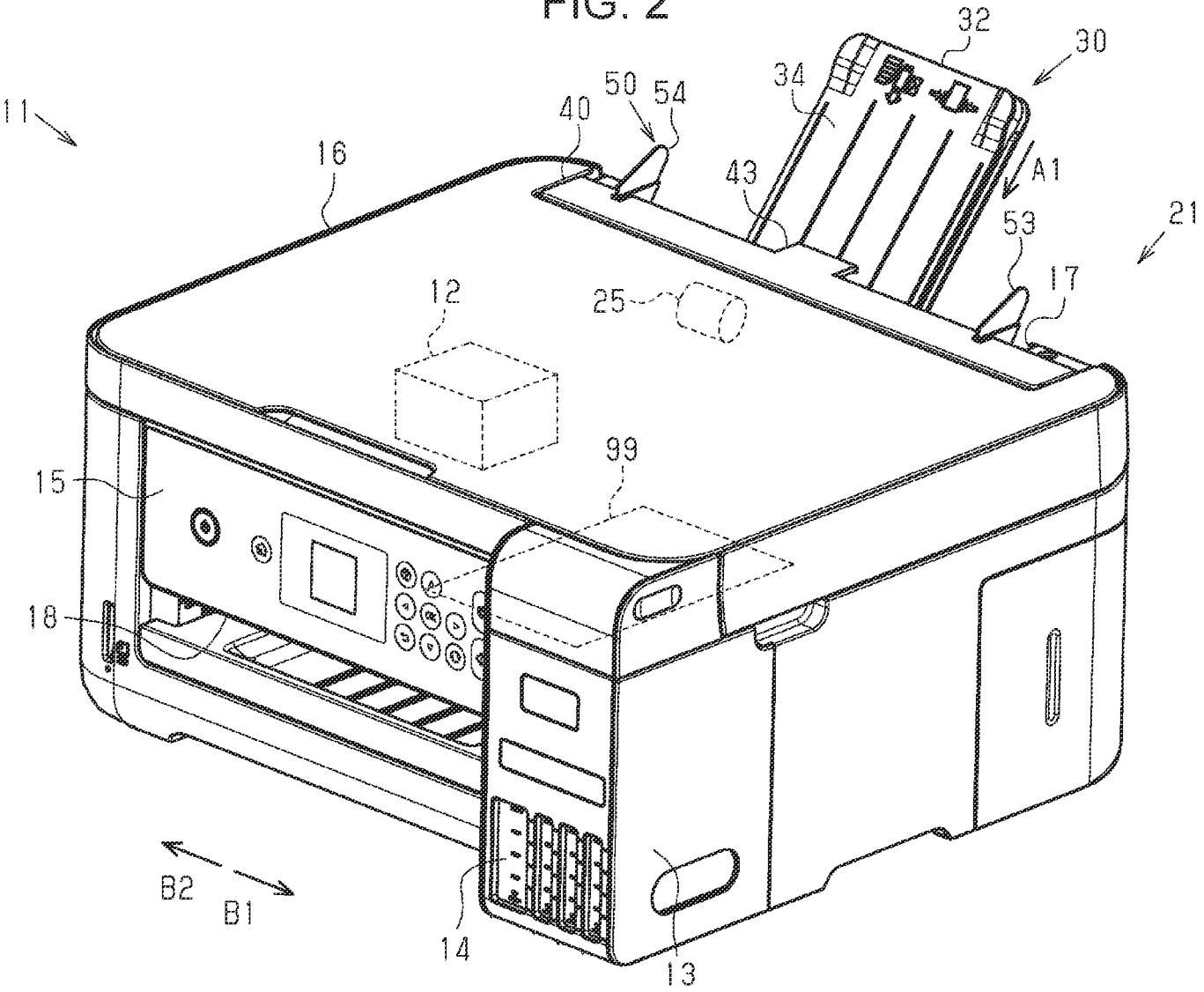
FIG. 2 is a perspective view in which a stacked unit is pulled out from FIG. 1.
Figure 3:
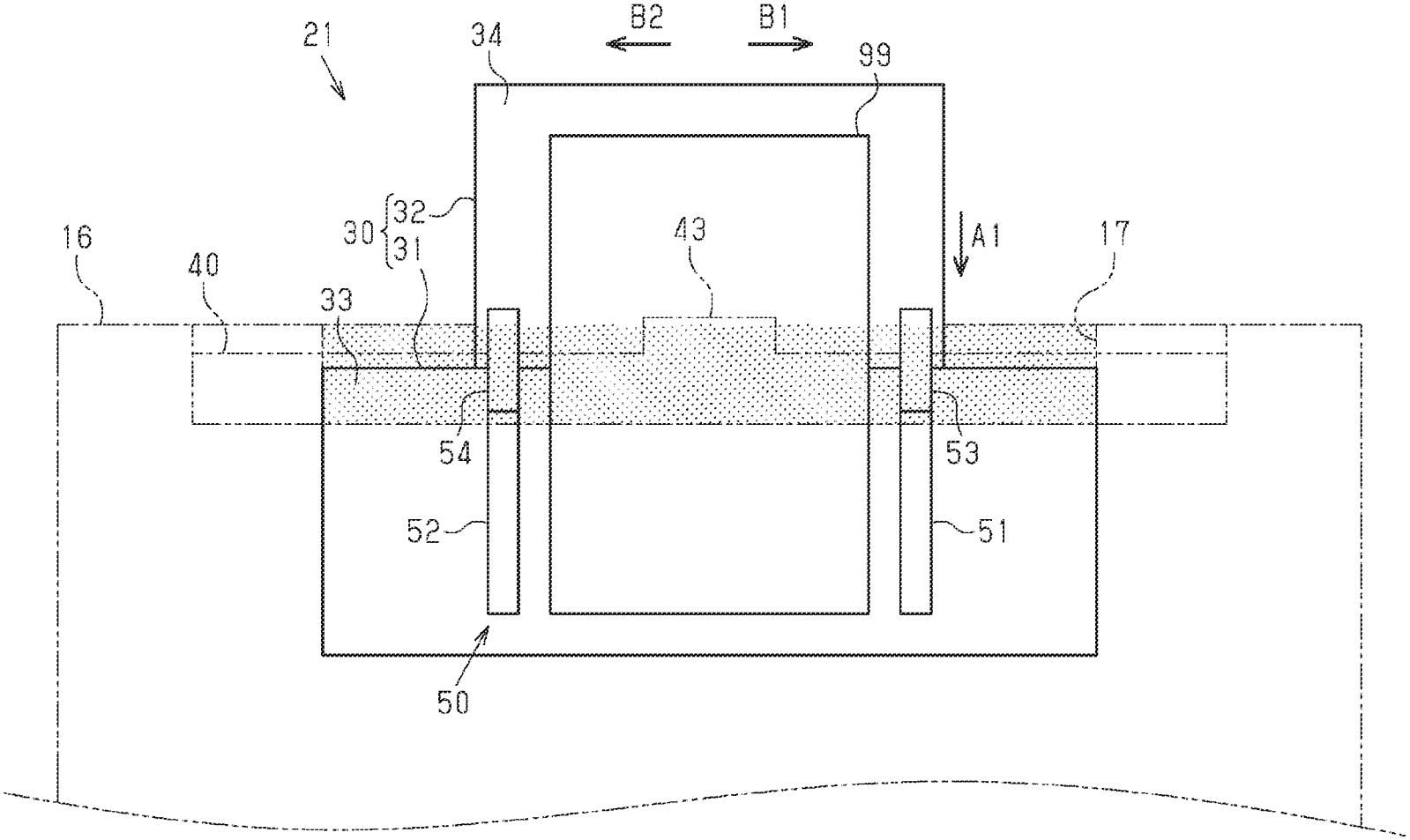
FIG. 3 is a top view of the stacked unit.

As illustrated in FIGS. 2 and 3, the medium feeding device 21 includes a stacked unit 30. One or a plurality of media 99 is stacked on the stacked unit 30. The stacked unit 30 is, for example, a tray. The stacked unit 30 extends to pass through the feed opening 17. The stacked unit 30 extends from the inside of the housing 16 to the outside of the housing 16 through the feed opening 17. That is to say, the stacked unit 30 extends from the inside to the outside of the housing 16 through the feed opening 17.

The stacked unit 30 is configured to be able to be accommodated in, for example, the housing 16. That is to say, the stacked unit 30 is configured to be able to be pulled out from the housing 16. The stacked unit 30 is pulled out from the housing 16 to extend to pass through the feed opening 17.

A medium 99 stacked on the stacked unit 30 is fed in a feed direction A1 by the feeding unit 25. The feed direction A1 is a direction in which a medium 99 is moved on the stacked unit 30 by the feeding unit 25. On the stacked unit 30, the downstream end, in the feed direction A1, of a medium 99 is inserted in the feed opening 17. Of a medium 99 stacked on the stacked unit 30, a portion of the medium 99 inserted in the feed opening 17 touches the feeding unit 25. A medium 99 stacked on the stacked unit 30 is fed to the recording unit 12 by the feeding unit 25. Therefore, the recording unit 12 records an image on a medium 99 stacked on the stacked unit 30.

The stacked unit 30 includes one or a plurality of stacked members. The stacked unit 30 includes, for example, two stacked members. In the present example, the stacked unit 30 includes a first stacked member 31 and a second stacked member 32.

As illustrated in FIG. 3, the first stacked member 31 is attached to, for example, the housing 16. The first stacked member 31 is located, for example, downstream of the feed opening 17 in the feed direction A1. Therefore, the first stacked member 31 is accommodated in the housing 16.

The second stacked member 32 is attached to the first stacked member 31. The second stacked member 32 is configured to be able to be pulled out from the first stacked member 31. That is to say, the second stacked member 32 is configured to be able to be accommodated in the first stacked member 31. The second stacked member 32 is pulled out from the first stacked member 31 to extend to the outside of the housing 16 through the feed opening 17. The second stacked member 32 is accommodated in the first stacked member 31 to be located in the housing 16.

When the second stacked member 32 is pulled out from the first stacked member 31, the second stacked member 32 and the first stacked member 31 align in this order in the feed direction A1. That is to say, when the second stacked member 32 is pulled out from the first stacked member 31, the second stacked member 32 is located upstream of the first stacked member 31 in the feed direction A1.

The second stacked member 32 is pulled out from the first stacked member 31 to lengthen the length, in the feed direction A1, of the stacked unit 30. Consequently, a user can stack a medium 99 that is long in the feed direction A1 on the stacked unit 30.

The stacked unit 30 may include three or more stacked members. For example, the stacked unit 30 may include the first stacked member 31, the second stacked member 32, and a third stacked member. In an example, the first stacked member 31 may be configured to be able to be pulled out from the third stacked member. In this case, the second stacked member 32, the first stacked member 31, and the third stacked member align in this order in the feed direction A1. In another example, the third stacked member may be configured to be able to be pulled out from the second stacked member 32. In this case, the third stacked member, the second stacked member 32, and the first stacked member 31 align in this order in the feed direction A1.

The stacked unit 30 may have a configuration including one stacked member, that is to say, a configuration including only the first stacked member 31. In this case, the first stacked member 31 extends to pass through the feed opening 17. The first stacked member 31 may be configured to be able to be accommodated in the housing 16, that is to say, to be able to be pulled out from the housing 16.

The stacked unit 30 has a stacked surface that touches a stacked medium 99. The stacked unit 30 has, for example, a first stacked surface 33 and a second stacked surface 34. The first stacked surface 33 is a surface of the first stacked member 31 that faces upward. Therefore, it is also mentioned that the first stacked member 31 has the first stacked surface 33. The second stacked surface 34 is a surface of the second stacked member 32 that faces upward. Therefore, it is also mentioned that the second stacked member 32 has the second stacked surface 34.

Figure 4:
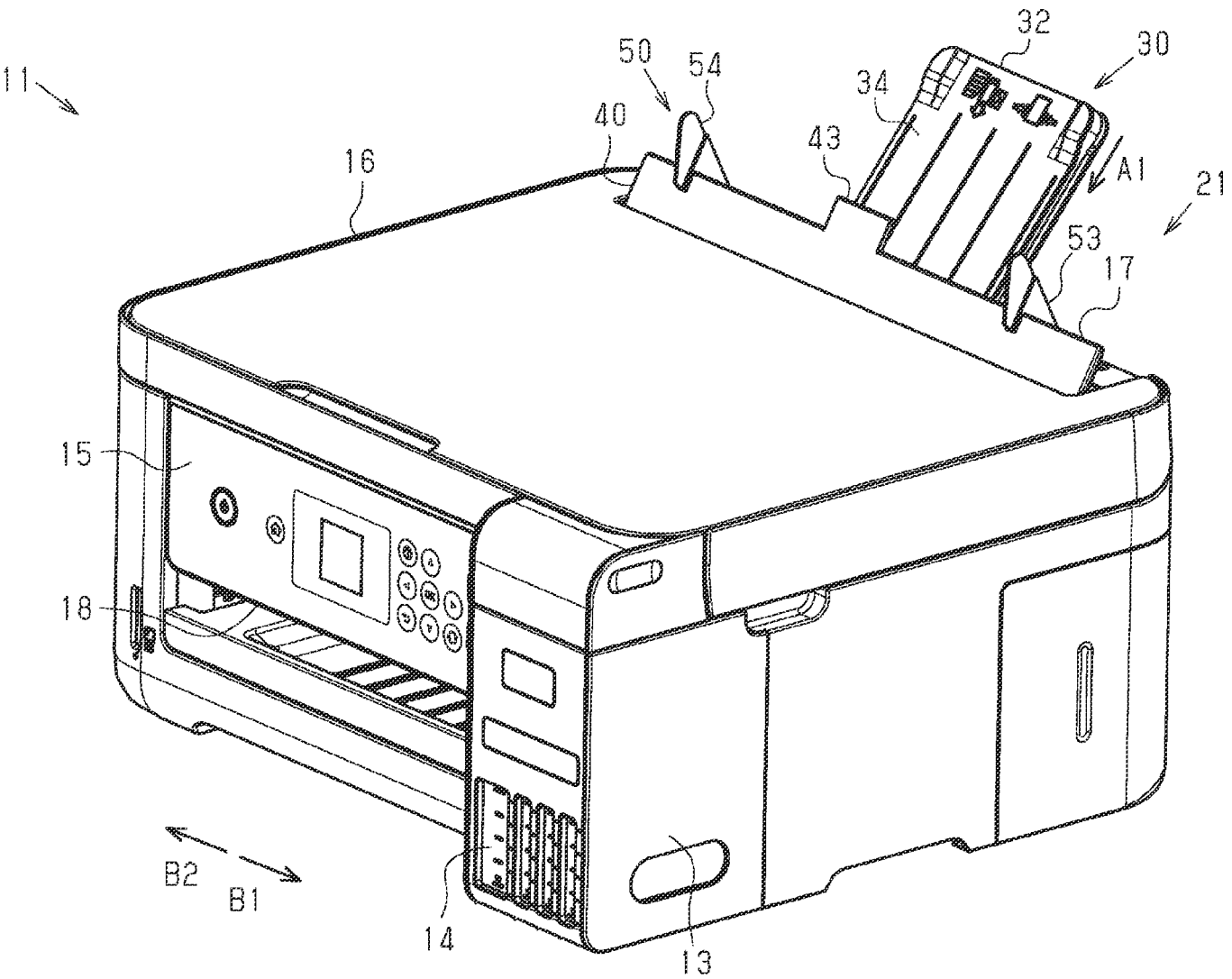
FIG. 4 is a perspective view in which a cover is opened from FIG. 2.
Figure 5:
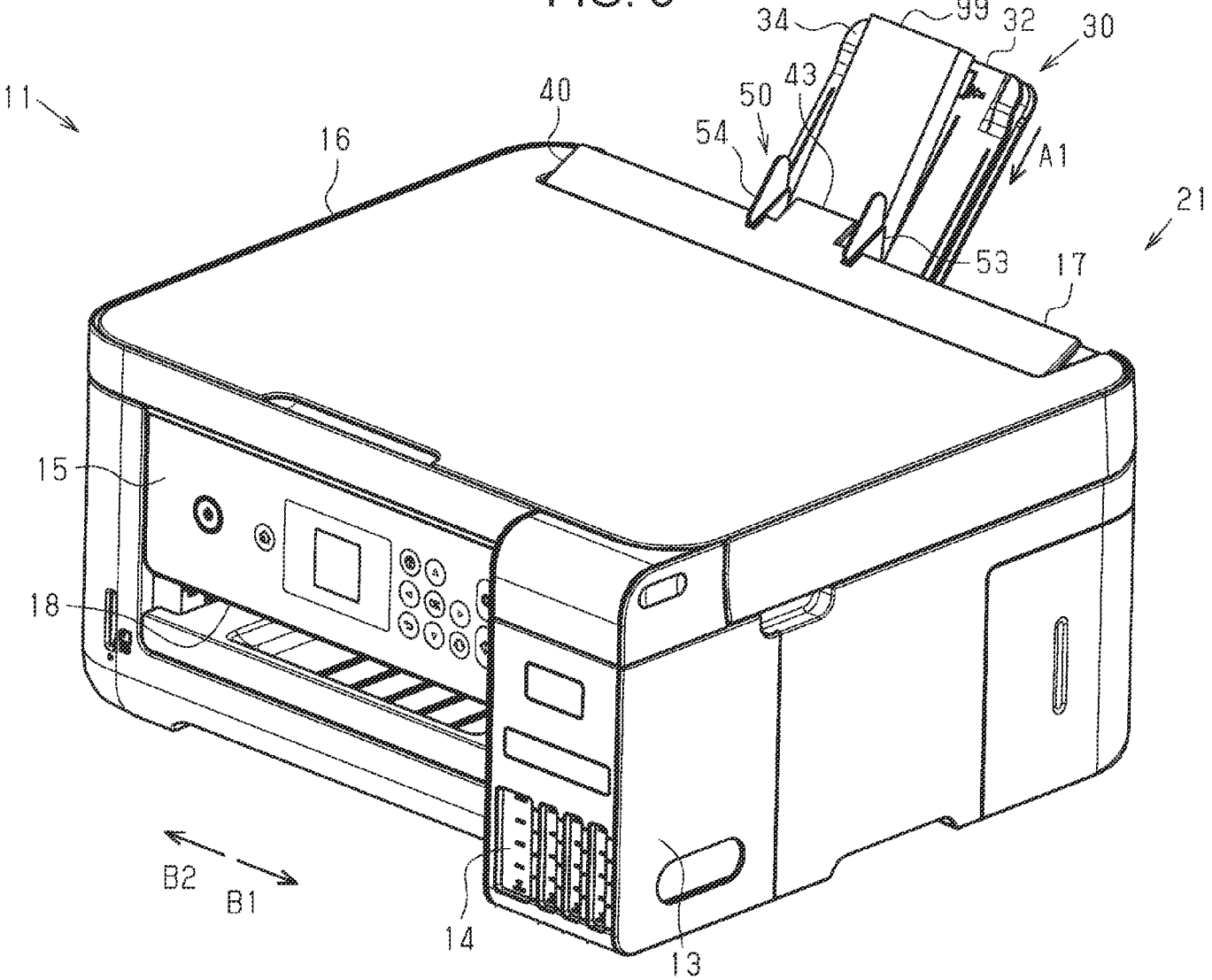
FIG. 5 is a perspective view in which media are stacked on the stacked unit from FIG. 4.
Figure 6:
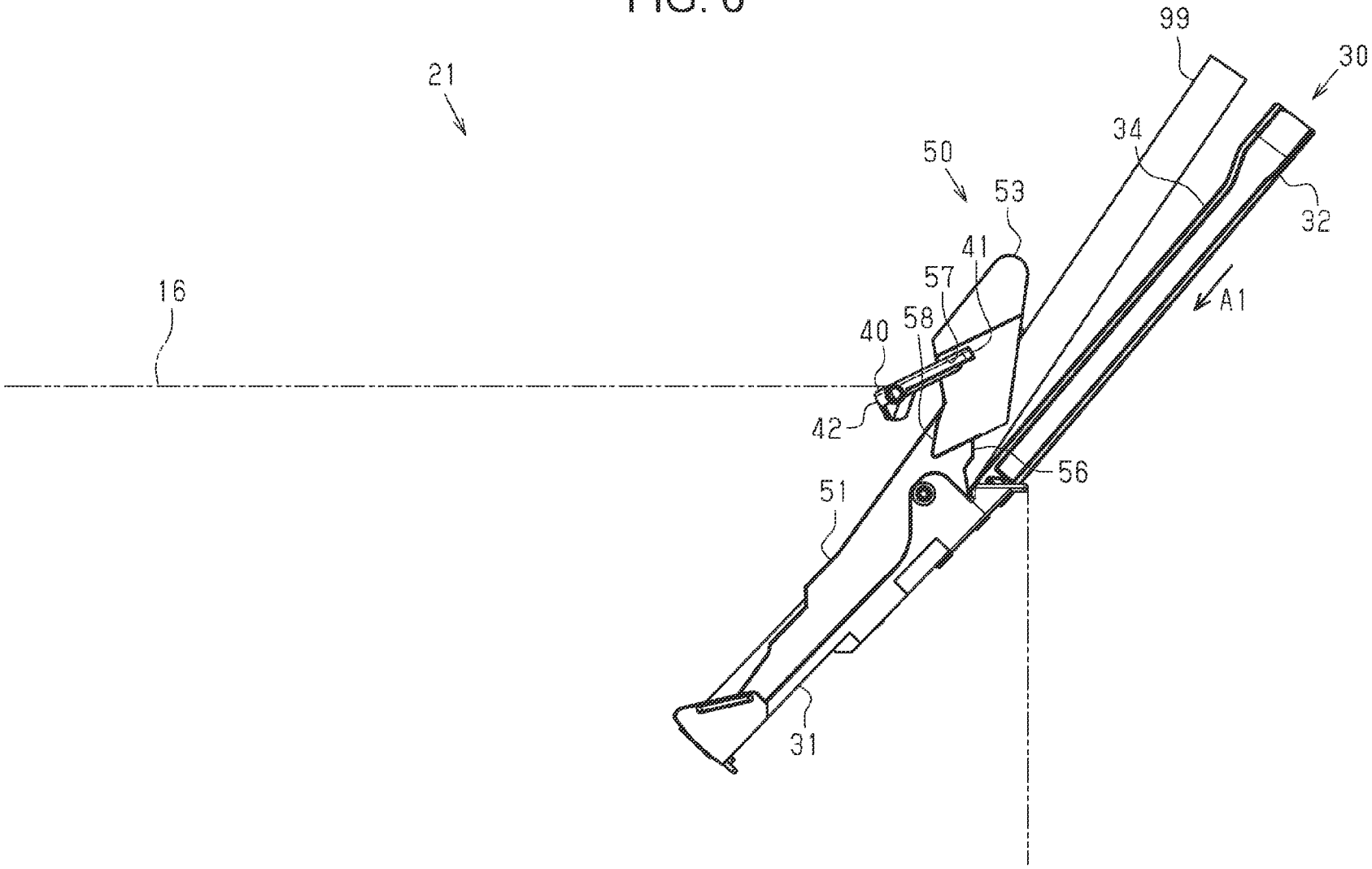
FIG. 6 is a side view of a regulating unit in FIG. 5.

As illustrated in FIGS. 4, 5, and 6, the medium feeding device 21 includes a cover 40. The cover 40 is attached to the housing 16. The cover 40 opens and closes relative to the feed opening 17. The cover 40 opens and closes by, for example, rotating. The cover 40 may open and close by sliding.

The cover 40 faces the stacked surface. More specifically, the back surface of the cover 40, a surface of the cover 40 opposite the front surface of the cover 40, faces the stacked surface. The cover 40 faces the first stacked surface 33 or the second stacked surface 34. For example, when the cover 40 is closed, the cover 40 faces the first stacked surface 33. For example, when the cover 40 is open, the cover 40 faces the second stacked surface 34.

For example, the cover 40 closes relative to the feed opening 17 to block at least part of the feed opening 17. More specifically, the cover 40 closes relative to the feed opening 17 to block part of the feed opening 17. The cover 40 blocks at least part of the feed opening 17, so that a possibility that dust enters the housing 16 through the feed opening 17 is reduced. When the cover 40 is closed, the front surface of the cover 40 is flush with the top surface of the housing 16.

When the cover 40 is closed, part of the feed opening 17 is blocked by the cover 40, while part of the feed opening 17 is open. Therefore, even when the cover 40 is closed, the stacked unit 30 can be pulled out from the housing 16 through the feed opening 17.

The cover 40 may block the entire feed opening 17 by closing relative to the feed opening 17. In this case, the cover 40 opens, so that the stacked unit 30 can be pulled out from the housing 16 through the feed opening 17.

The cover 40 opens relative to the feed opening 17 to expose the inside of the housing 16. Therefore, when the cover 40 opens, members located in the housing 16 are exposed. For example, when the cover 40 opens, the first stacked member 31 is exposed.

When the cover 40 opens, the feed opening 17 is widely open compared to a case where the cover 40 is closed. Therefore, the cover 40 opens to facilitate inserting a medium 99 into the feed opening 17. Therefore, the cover 40 opens to facilitate stacking a medium 99 on the stacked unit 30.

When the cover 40 is closed with a medium 99 stacked on the stacked unit 30, the medium 99 stacked on the stacked unit 30 is sandwiched between the stacked unit 30 and the cover 40. At this time, the cover 40 presses the medium 99 stacked on the stacked unit 30. The cover 40 presses the medium 99 stacked on the stacked unit 30, so that the posture of the medium 99 is stabilized. The cover 40 touches the medium 99 stacked on the stacked unit 30 to become in a state of slightly opening relative to the feed opening 17.

Figure 7:
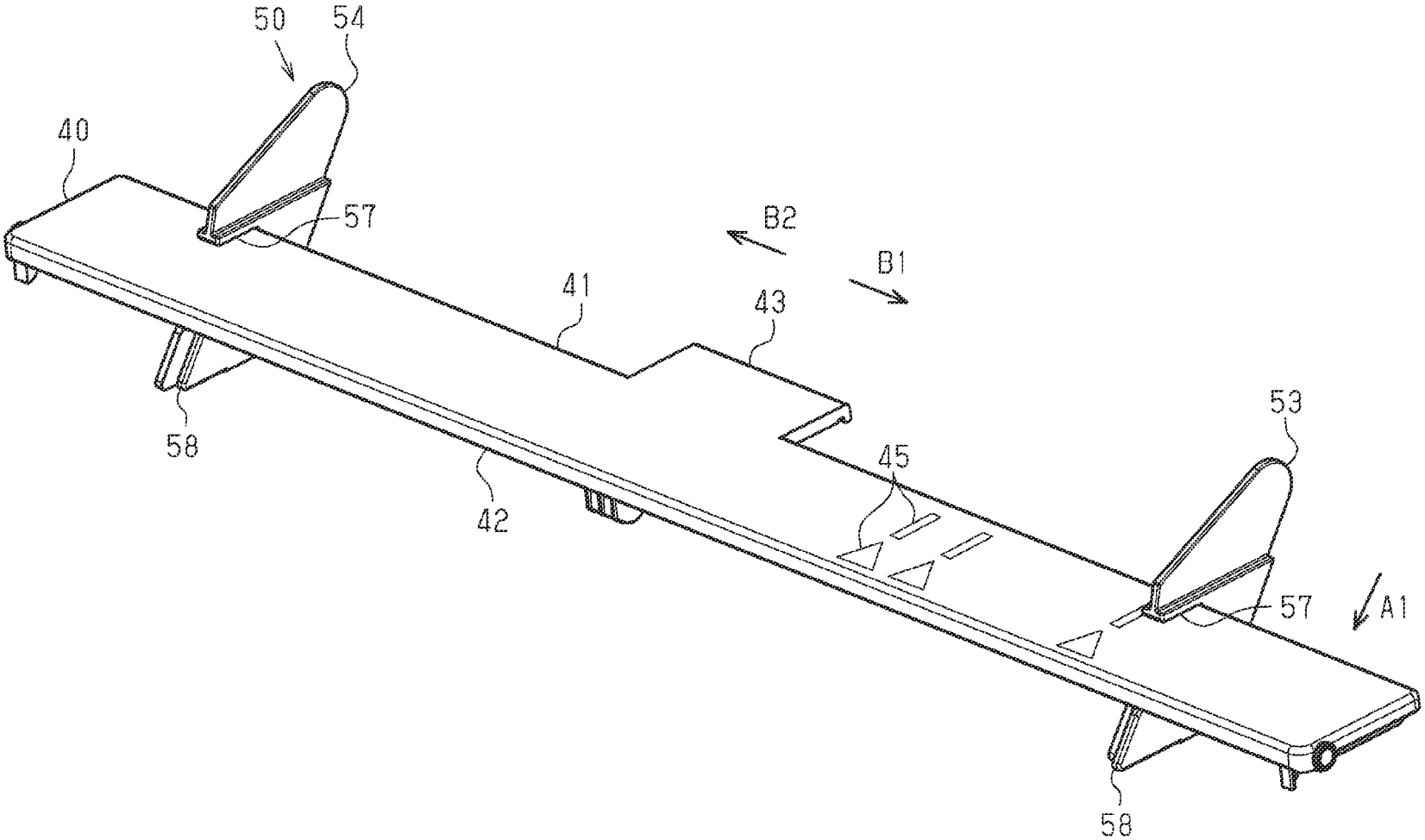
FIG. 7 is a perspective view of the cover.

As illustrated in FIG. 7, the cover 40 has a first end portion 41 and a second end portion 42. The first end portion 41 is an end portion displaced when the cover 40 rotates. The first end portion 41 includes, for example, the upstream end, in the feed direction A1, of the cover 40. The second end portion 42 is an end portion serving as an axis when the cover 40 rotates. The second end portion 42 includes, for example, the downstream end, in the feed direction A1, of the cover 40.

The cover 40 has a projection 43. The projection 43 touches a medium 99 stacked on the stacked unit 30. The projection 43 is located at the first end portion 41. The projection 43 protrudes from the first end portion 41. The projection 43 touches a medium 99 stacked on the stacked unit 30, so that the cover 40 presses the medium 99.

The cover 40 has an indicator 45. The indicator 45 is located on the front surface of the cover 40. The indicator 45 indicates the size of a medium 99 stacked on the stacked unit 30. More specifically, the indicator 45 indicates the size of a medium 99 stacked on the stacked unit 30, based on the position of a regulating unit 50 described below. The indicator 45 includes, for example, a scale, symbols, characters, or the like indicating the size of a medium 99. The indicator 45 may be engraved on or attached to the front surface of the cover 40. Regarding the sizes of media 99, the indicator 45 may indicate one of the sizes or may indicate a plurality of the sizes. For example, the indicator 45 indicates sizes, such as A4, B5, and postcard.

As illustrated in FIGS. 3, 4, and 5, the medium feeding device 21 includes the regulating unit 50. The regulating unit 50 is configured to regulate the position of a medium 99 stacked on the stacked unit 30, in width directions. The regulating unit 50 is, for example, edge guides. The regulating unit 50 sandwiches a medium 99 stacked on the stacked unit 30, in the width directions to regulate the position of the medium 99 in the width directions. The regulating unit 50 moves in the width directions to sandwich a medium 99 in the width directions. A user directly operates the regulating unit 50 by hand.

The width directions are directions serving as indexes representing the width of a medium 99. The width directions refer to both a first direction B1 and a second direction B2. The first direction B1 and the second direction B2 are opposite to each other. Both the first direction B1 and the second direction B2 are directions different from the feed direction A1. For example, when the image recording apparatus 11 is a serial printer, the width directions coincide with directions in which the recording unit 12 scans. For example, when the image recording apparatus 11 is a line printer, the width directions coincide with lengthways directions of the recording unit 12.

The regulating unit 50 regulates the position of a medium 99 in the width directions, so that the inclination of the medium 99 stacked on the stacked unit 30 is reduced. When a medium 99 in an inclined state is fed, there is a possibility that the medium 99 jams in the housing 16. Therefore, the regulating unit 50 regulates the position of a medium 99 in the width directions, so that the medium 99 is appropriately fed into the housing 16.

As illustrated in FIG. 3, the regulating unit 50 includes two main regulating members. As the two main regulating members, the regulating unit 50 includes a first main regulating member 51 and a second main regulating member 52. The regulating unit 50 includes one or two subordinate regulating members. In the present example, the regulating unit 50 includes two subordinate regulating members. As the two subordinate regulating members, the regulating unit 50 includes a first subordinate regulating member 53 and a second subordinate regulating member 54.

The first main regulating member 51 is attached to the stacked unit 30. More specifically, the first main regulating member 51 is attached to the first stacked member 31. The first main regulating member 51 protrudes from the first stacked surface 33. The first main regulating member 51 is configured to be movable in the width directions. That is to say, the first main regulating member 51 slides relative to the stacked unit 30 in the width directions. The first main regulating member 51 is configured to be linked to and cooperate with the first subordinate regulating member 53.

The second main regulating member 52 is attached to the stacked unit 30. More specifically, the second main regulating member 52 is attached to the first stacked member 31. The second main regulating member 52 protrudes from the first stacked surface 33. Similarly to the first main regulating member 51, the second main regulating member 52 is configured to, for example, be movable in the width directions. That is to say, the second main regulating member 52 slides relative to the stacked unit 30 in the width directions. The second main regulating member 52 is configured to be linked to and cooperate with the second subordinate regulating member 54.

The first main regulating member 51 and the second main regulating member 52 are located with a predetermined gap between the first main regulating member 51 and the second main regulating member 52 in the width directions. The first main regulating member 51 and the second main regulating member 52 move on the first stacked surface 33 in the width directions.

In the present example, the first main regulating member 51 and the second main regulating member 52 are configured to be linked together and cooperate. More specifically, the first main regulating member 51 and the second main regulating member 52 are linked together and cooperate to move in the respective opposite width directions. More specifically, when the first main regulating member 51 moves in the first direction B1, the second main regulating member 52 moves in the second direction B2. When the first main regulating member 51 moves in the second direction B2, the second main regulating member 52 moves in the first direction B1. In this way, the first main regulating member 51 and the second main regulating member 52 move toward or away from each other in the width directions. As a result, the gap between the first main regulating member 51 and the second main regulating member 52 in the width directions varies. Consequently, the first main regulating member 51 and the second main regulating member 52 sandwich a medium 99 in the width directions.

When the first main regulating member 51 and the second main regulating member 52 are linked together and cooperate, the regulating unit 50 regulates the position of a medium 99 in the width directions, with the center between the first main regulating member 51 and the second main regulating member 52, as the criterion. Therefore, the regulating unit 50 is of what is called a center criterion type.

The first main regulating member 51 and the second main regulating member 52 are not limited to the linked and cooperative configuration. For example, the second main regulating member 52 may be fixed to the stacked unit 30. In this case, the second main regulating member 52 is fixed to the first stacked member 31. The first main regulating member 51 moves in the width directions to move toward or away from the second main regulating member 52. As a result, the gap between the first main regulating member 51 and the second main regulating member 52 varies. Consequently, the first main regulating member 51 and the second main regulating member 52 sandwich a medium 99 in the width directions.

When the second main regulating member 52 is fixed to the stacked unit 30, the regulating unit 50 regulates the position of a medium 99 in the width directions, with the second main regulating member 52 as the criterion. In this case, the regulating unit 50 is of what is called a one-side criterion type.

Next, the regulating unit 50 of the center criterion type will be described in detail.

Figure 8:
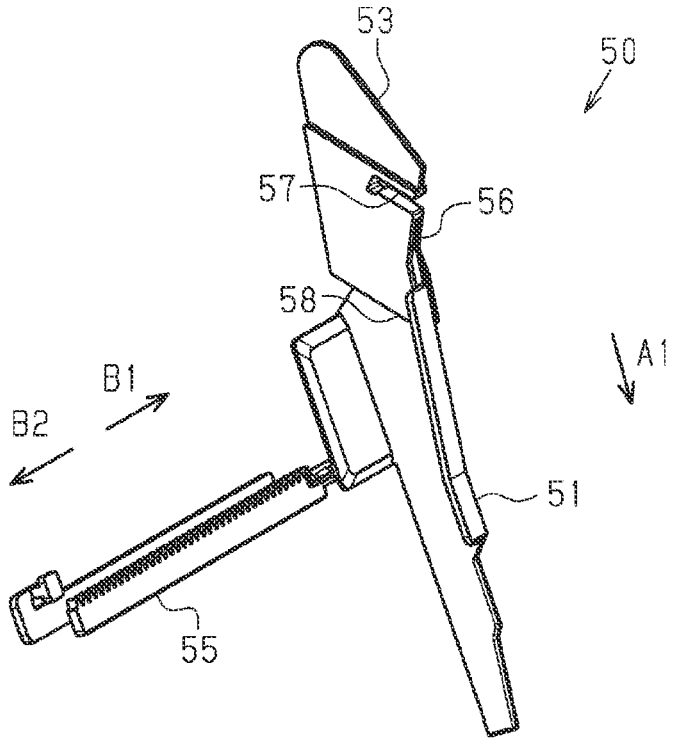
FIG. 8 is a perspective view of the regulating unit.

As illustrated in FIG. 8, the first main regulating member 51 includes a coupling member 55. The coupling member 55 is, for example, a rack. The second main regulating member 52 has a configuration similar to the configuration of the first main regulating member 51. Therefore, the second main regulating member 52 similarly includes a coupling member 55. The coupling member 55 of the first main regulating member 51 extends in the second direction B2. The coupling member 55 of the second main regulating member 52 extends in the first direction B1.

The coupling member 55 of the first main regulating member 51 and the coupling member 55 of the second main regulating member 52 are coupled together, so that the first main regulating member 51 and the second main regulating member 52 are linked together and cooperate. The coupling member 55 of the first main regulating member 51 and the coupling member 55 of the second main regulating member 52 are coupled together through, for example, a pinion. Consequently, the first main regulating member 51 and the second main regulating member 52 are linked together and cooperate to move in respective opposite directions.

As illustrated in FIG. 3, at least part of the first main regulating member 51 is located downstream of the feed opening 17 in the feed direction A1. For example, the downstream end, in the feed direction A1, of the first main regulating member 51 is located downstream of the feed opening 17 in the feed direction A1. That is to say, the downstream end of the first main regulating member 51 is located in the housing 16. In this case, the first main regulating member 51 touches a medium 99 stacked on the stacked unit 30, at a portion of the medium 99 inserted in the housing 16 through the feed opening 17. In FIG. 3, a dot-hatched area indicates an area of the feed opening 17 when the medium feeding device 21 is seen from above.

In the present example, not only the downstream end of the first main regulating member 51 but also the entire first main regulating member 51 is located downstream of the feed opening 17. That is to say, in the present example, the entire first main regulating member 51 is located in the housing 16. When the first main regulating member 51 regulates the position of a medium 99, it is preferable that the first main regulating member 51 touches the most downstream portion of the medium 99, which is not limiting. For example, the first main regulating member 51 may touch a midstream portion of a medium 99 without touching a downstream portion of the medium 99.

Since the first main regulating member 51 is located downstream of the feed opening 17, the first main regulating member 51 is covered by the cover 40 that is closed. The cover 40 opens to expose the first main regulating member 51. Therefore, it is difficult for a user to access the first main regulating member 51 when the cover 40 is closed. A user opens the cover 40 to access the first main regulating member 51.

Similarly to the first main regulating member 51, at least part of the second main regulating member 52 is located downstream of the feed opening 17 in the feed direction A1. For example, the downstream end, in the feed direction A1, of the second main regulating member 52 is located downstream of the feed opening 17 in the feed direction A1. That is to say, the downstream end of the second main regulating member 52 is located in the housing 16. In this case, the second main regulating member 52 touches a medium 99 stacked on the stacked unit 30, at a portion of the medium 99 inserted in the housing 16 through the feed opening 17.

In the present example, not only the downstream end of the second main regulating member 52 but also the entire second main regulating member 52 is located downstream of the feed opening 17. That is to say, in the present example, the entire second main regulating member 52 is located in the housing 16. When the second main regulating member 52 regulates the position of a medium 99, it is preferable that the second main regulating member 52 touches the most downstream portion of the medium 99, which is not limiting. For example, the second main regulating member 52 may touch a midstream portion of a medium 99 without touching a downstream portion of the medium 99.

Since the second main regulating member 52 is located downstream of the feed opening 17, the second main regulating member 52 is covered by the cover 40 that is closed. The cover 40 opens to expose the second main regulating member 52. Therefore, when the cover 40 is closed, it is difficult for a user to access the second main regulating member 52. A user opens the cover 40 to access the second main regulating member 52.

The first main regulating member 51 and the second main regulating member 52 sandwich a downstream portion of a medium 99 stacked on the stacked unit 30. Consequently, the regulating unit 50 further reduces the inclination of a medium 99 stacked on the stacked unit 30. The first main regulating member 51 and the second main regulating member 52 sandwich the most downstream portion of a medium 99 to effectively reduce the inclination of the medium 99.

As illustrated in FIG. 8, the first main regulating member 51 has a main coupled portion 56. In the first main regulating member 51, the main coupled portion 56 is a portion coupled to the first subordinate regulating member 53. In the first main regulating member 51, the main coupled portion 56 is an upstream portion in the feed direction A1. Therefore, the main coupled portion 56 of the first main regulating member 51 includes the upstream end, in the feed direction A1, of the first main regulating member 51. The first main regulating member 51 is coupled to the first subordinate regulating member 53 by the main coupled portion 56 to be linked to and cooperate with the first subordinate regulating member 53.

Similarly to the first main regulating member 51, the second main regulating member 52 has a main coupled portion 56. In the second main regulating member 52, the main coupled portion 56 is a portion coupled to the second subordinate regulating member 54. In the second main regulating member 52, the main coupled portion 56 is an upstream portion in the feed direction A1. Therefore, the main coupled portion 56 of the second main regulating member 52 includes the upstream end, in the feed direction A1, of the second main regulating member 52. The second main regulating member 52 is coupled to the second subordinate regulating member 54 by the main coupled portion 56 to be linked to and cooperate with the second subordinate regulating member 54.

As illustrated in FIG. 7, the first subordinate regulating member 53 is attached to the cover 40. More specifically, the first subordinate regulating member 53 is attached to the first end portion 41. Therefore, opening and closing of the cover 40 is accompanied by the displacement of the first subordinate regulating member 53. That is to say, the first subordinate regulating member 53 follows the cover 40.

The first subordinate regulating member 53 is configured to be movable in the width directions. That is to say, the first subordinate regulating member 53 slides relative to the cover 40 in the width directions. The first subordinate regulating member 53 has, for example, a slit 57. The first end portion 41 is inserted in the slit 57. The first end portion 41 is inserted in the slit 57, so that the first subordinate regulating member 53 is located such that the first subordinate regulating member 53 straddles the front surface of the cover 40 and the back surface of the cover 40. The first subordinate regulating member 53 slides in the width directions with the first end portion 41 inserted in the slit 57. The first subordinate regulating member 53 is configured to be linked to and cooperate with the first main regulating member 51.

Similarly to the first subordinate regulating member 53, the second subordinate regulating member 54 is attached to the cover 40. More specifically, the second subordinate regulating member 54 is attached to the first end portion 41. Therefore, opening and closing of the cover 40 is accompanied by the displacement of the second subordinate regulating member 54. That is to say, the second subordinate regulating member 54 follows the cover 40.

Similarly to the first subordinate regulating member 53, the second subordinate regulating member 54 is configured to be movable in the width directions. That is to say, the second subordinate regulating member 54 slides relative to the cover 40 in the width directions. Similarly to the first subordinate regulating member 53, the second subordinate regulating member 54 has, for example, a slit 57. The first end portion 41 is inserted in the slit 57, so that the second subordinate regulating member 54 is located such that the second subordinate regulating member 54 straddles the front surface of the cover 40 and the back surface of the cover 40. The second subordinate regulating member 54 slides in the width directions with the first end portion 41 inserted in the slit 57. The second subordinate regulating member 54 is configured to be linked to and cooperate with the second main regulating member 52.

The first subordinate regulating member 53 moves in the width directions to become on the indicator 45. That is to say, the first subordinate regulating member 53 becomes on the indicator 45, so that the indicator 45 indicates the size of a medium 99 stacked on the stacked unit 30. In this manner, the indicator 45 indicates the size of a medium 99 stacked on the stacked unit 30, based on the position of the first subordinate regulating member 53. That is to say, the indicator 45 is located in an area of the cover 40 where the first subordinate regulating member 53 moves.

The second subordinate regulating member 54 may become on the indicator 45, so that the indicator 45 indicates the size of a medium 99 stacked on the stacked unit 30. That is to say, the indicator 45 may indicate the size of a medium 99 stacked on the stacked unit 30, based on the position of the second subordinate regulating member 54. In this case, the indicator 45 is located in an area of the cover 40 where the second subordinate regulating member 54 moves. The indicator 45 may be located in both the area of the cover 40 where the first subordinate regulating member 53 moves, and the area of the cover 40 where the second subordinate regulating member 54 moves.

As illustrated in FIG. 8, the first subordinate regulating member 53 is located upstream of the first main regulating member 51 in the feed direction A1. More specifically, the first subordinate regulating member 53 is located upstream of the downstream end of the first main regulating member 51 in the feed direction A1. In other words, the downstream end, in the feed direction A1, of the first main regulating member 51 is located downstream of the first subordinate regulating member 53 in the feed direction A1. Therefore, the first subordinate regulating member 53 and the first main regulating member 51 align in this order in the feed direction A1.

The positional relationship of the second subordinate regulating member 54 relative to the second main regulating member 52 is similar to the positional relationship of the first subordinate regulating member 53 relative to the first main regulating member 51. That is to say, the second subordinate regulating member 54 is located upstream of the second main regulating member 52 in the feed direction A1. More specifically, the second subordinate regulating member 54 is located upstream of the downstream end of the second main regulating member 52 in the feed direction A1. In other words, the downstream end, in the feed direction A1, of the second main regulating member 52 is located downstream of the second subordinate regulating member 54 in the feed direction A1. Therefore, the second subordinate regulating member 54 and the second main regulating member 52 align in this order in the feed direction A1.

The first subordinate regulating member 53 has a subordinate coupled portion 58. In the first subordinate regulating member 53, the subordinate coupled portion 58 is a portion coupled to the first main regulating member 51. In the first subordinate regulating member 53, the subordinate coupled portion 58 is a downstream portion in the feed direction A1. Therefore, the subordinate coupled portion 58 of the first subordinate regulating member 53 includes the downstream end of the first subordinate regulating member 53. The first subordinate regulating member 53 is coupled to the first main regulating member 51 by the subordinate coupled portion 58 to be linked to and cooperate with the first main regulating member 51.

The subordinate coupled portion 58 is coupled to the main coupled portion 56. In the present example, the subordinate coupled portion 58 sandwiches the main coupled portion 56 in the width directions to be coupled to the main coupled portion 56. In other words, the main coupled portion 56 is inserted into the subordinate coupled portion 58, so that the subordinate coupled portion 58 and the main coupled portion 56 are coupled together. The subordinate coupled portion 58 is located on both sides, in the width directions, of the main coupled portion 56. Therefore, the subordinate coupled portion 58 touches a medium 99 when the regulating unit 50 regulates the position of the medium 99. That is to say, the subordinate coupled portion 58 contributes to regulating the position of a medium 99. Consequently, the inclination of a medium 99 becomes easily reduced.

The main coupled portion 56 may sandwich the subordinate coupled portion 58 in the width directions, so that the subordinate coupled portion 58 is coupled to the main coupled portion 56. In other words, the subordinate coupled portion 58 may be inserted into the main coupled portion 56, so that the subordinate coupled portion 58 and the main coupled portion 56 are coupled together. In this case, the main coupled portion 56 is located on both sides, in the width directions, of the subordinate coupled portion 58. Therefore, the main coupled portion 56 touches a medium 99 when the regulating unit 50 regulates the position of the medium 99. That is to say, the main coupled portion 56 contributes to regulating the position of a medium 99. Consequently, the inclination of a medium 99 becomes easily reduced.

With these configurations, the downstream end of the first subordinate regulating member 53 and the upstream end of the first main regulating member 51 are coupled together. Therefore, when the first subordinate regulating member 53 moves in the width directions, the first main regulating member 51 also moves in the width directions. Therefore, the first main regulating member 51 and the first subordinate regulating member 53 are linked together and cooperate.

Figure 9:
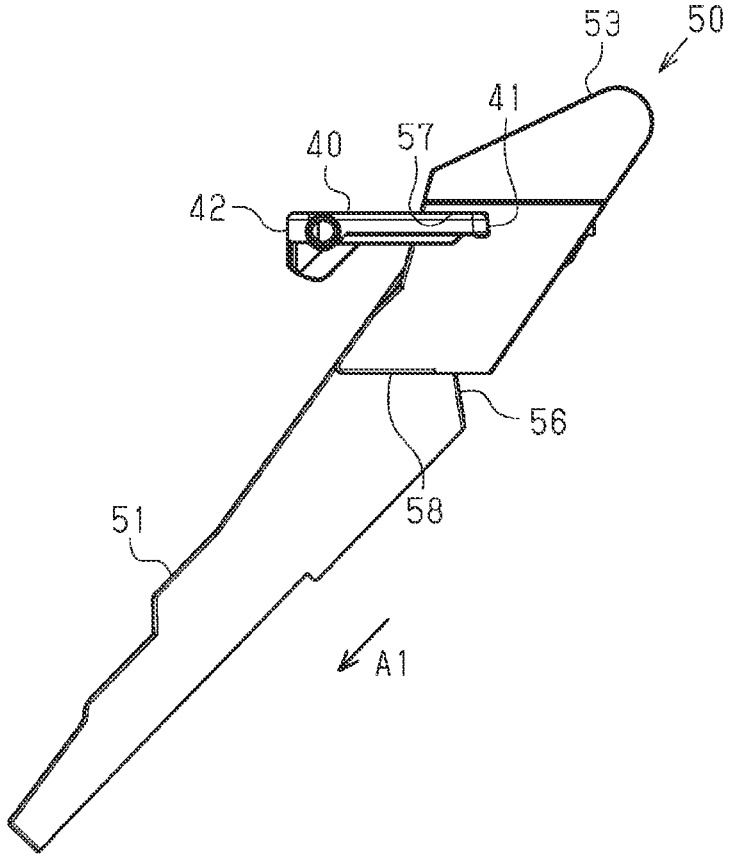
FIG. 9 is a side view of the regulating unit when the cover is closed.
Figure 10:
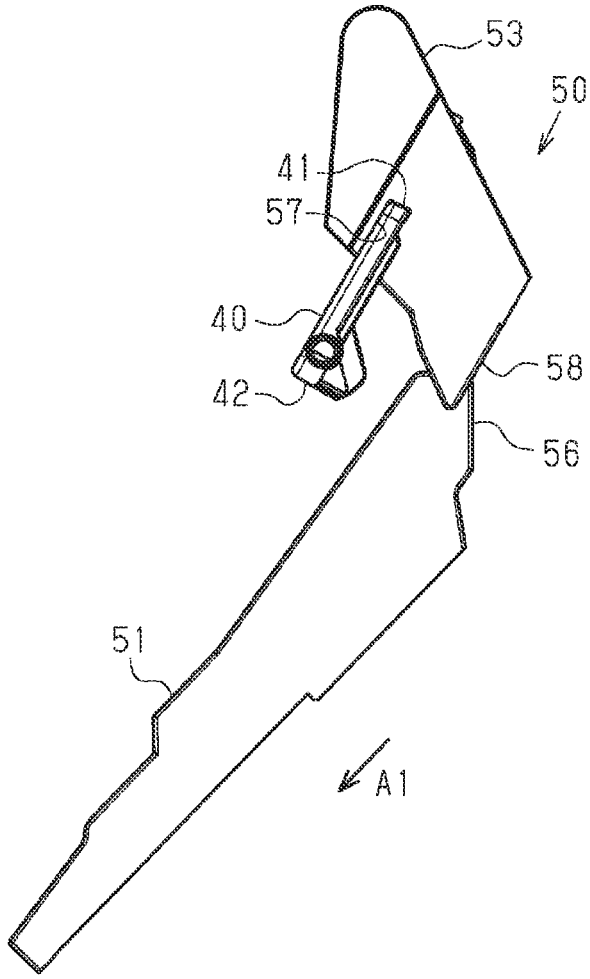
FIG. 10 is a side view of the regulating unit when the cover is open.

As illustrated in FIGS. 9 and 10, the subordinate coupled portion 58 is configured to keep the coupling of the subordinate coupled portion 58 and the main coupled portion 56 whether the cover 40 is open or closed. That is to say, the subordinate coupled portion 58 sandwiches the main coupled portion 56 in the width directions whether the cover 40 is open or closed. Consequently, the coupling of the main coupled portion 56 and the subordinate coupled portion 58 is kept whether the cover 40 is open or closed.

A structure that couples the second subordinate regulating member 54 to the second main regulating member 52 is similar to the structure that couples the first subordinate regulating member 53 to the first main regulating member 51. That is to say, similarly to the first subordinate regulating member 53, the second subordinate regulating member 54 has a subordinate coupled portion 58. In the second subordinate regulating member 54, the subordinate coupled portion 58 is a portion coupled to the second main regulating member 52. In the second subordinate regulating member 54, the subordinate coupled portion 58 is a downstream portion in the feed direction A1. Therefore, the subordinate coupled portion 58 of the second subordinate regulating member 54 includes the downstream end of the second subordinate regulating member 54. The second subordinate regulating member 54 is coupled to the second main regulating member 52 by the subordinate coupled portion 58 to be linked to and cooperate with the second main regulating member 52.

Similarly to the first subordinate regulating member 53 and the first main regulating member 51, the downstream end of the second subordinate regulating member 54 and the upstream end of the second main regulating member 52 are coupled together by the subordinate coupled portion 58 and a main coupled portion 56. Therefore, when the second subordinate regulating member 54 moves in the width directions, the second main regulating member 52 also moves in the width directions. Therefore, the second main regulating member 52 and the second subordinate regulating member 54 are linked together and cooperate. Also in the second main regulating member 52 and the second subordinate regulating member 54, the subordinate coupled portion 58 sandwiches the main coupled portion 56 in the width directions whether the cover 40 is open or closed.

The first subordinate regulating member 53 and the second subordinate regulating member 54 are linked together and cooperate through the first main regulating member 51 and the second main regulating member 52. For example, the first subordinate regulating member 53 and the second subordinate regulating member 54 are linked together and cooperate to move in the respective opposite width directions. More specifically, when the first subordinate regulating member 53 moves in the first direction B1, the first main regulating member 51 moves in the first direction B1. When the first main regulating member 51 moves in the first direction B1, the second main regulating member 52 moves in the second direction B2. When the second main regulating member 52 moves in the second direction B2, the second subordinate regulating member 54 moves in the second direction B2. Therefore, when a user moves the first subordinate regulating member 53 or the second subordinate regulating member 54, the first main regulating member 51 and the second main regulating member 52 move.

The first subordinate regulating member 53 and the second subordinate regulating member 54 move toward or away from each other in the width directions. As a result, the gap between the first subordinate regulating member 53 and the second subordinate regulating member 54 varies. The first subordinate regulating member 53 and the second subordinate regulating member 54 may or may not sandwich a medium 99 stacked on the stacked unit 30, in the width directions. When the first subordinate regulating member 53 and the second subordinate regulating member 54 sandwich a medium 99, the inclination of the medium 99 stacked on the stacked unit 30 is further reduced compared to a case where the first subordinate regulating member 53 and the second subordinate regulating member 54 do not sandwich a medium 99. When the first subordinate regulating member 53 and the second subordinate regulating member 54 sandwich a medium 99, the subordinate coupled portions 58 touch the medium 99, so that the inclination of the medium 99 stacked on the stacked unit 30 is much further reduced.

As described above, the first main regulating member 51 and the second main regulating member 52 sandwich the downstream end of a medium 99 to effectively reduce the inclination of the medium 99. On the other hand, since in this case, the first main regulating member 51 and the second main regulating member 52 are located downstream of the feed opening 17, it is difficult for a user to access the first main regulating member 51 and the second main regulating member 52. That is to say, it is difficult for a user to operate the first main regulating member 51 and the second main regulating member 52.

In the present example, the regulating unit 50 includes the first subordinate regulating member 53 and the second subordinate regulating member 54 that are attached to the cover 40. A user operates the first subordinate regulating member 53 or the second subordinate regulating member 54 to move the first main regulating member 51 and the second main regulating member 52 in the width directions. Therefore, a user operates the first main regulating member 51 and the second main regulating member 52 without opening the cover 40. Consequently, it is easy for a user to operate the regulating unit 50.

Unlike the first main regulating member 51 and the second main regulating member 52 that are located downstream of the feed opening 17, the first subordinate regulating member 53 and the second subordinate regulating member 54 are attached to the cover 40. Therefore, it is easy for a user to visually recognize the first subordinate regulating member 53 and the second subordinate regulating member 54, compared to the first main regulating member 51 and the second main regulating member 52, whether the cover 40 is open or closed. From the above, the first subordinate regulating member 53 and the second subordinate regulating member 54 improve the ease of visual recognition of the regulating unit 50 and the ease of operation of the regulating unit 50 for the user. Therefore, the subordinate regulating members improve the usability.

Next, actions and effects of the above-described embodiment will be described.

(1) The first main regulating member 51 is linked to and cooperates with the first subordinate regulating member 53 attached to the cover 40. A user moves the first subordinate regulating member 53 to move the first main regulating member 51. That is to say, a user operates the regulating unit 50 without opening the cover 40. Therefore, it is easy for a user to operate the regulating unit 50.

(2) The first main regulating member 51 and the second main regulating member 52 are linked together and cooperate to move in the respective opposite width directions to sandwich a medium 99 in the width directions. Therefore, the regulating unit 50 regulates the position of a medium 99 in the width directions, with the center between the first main regulating member 51 and the second main regulating member 52, as the criterion. Consequently, the possibility that a medium 99 in an inclined state is fed is reduced. In addition, when the regulating unit 50 is of a center criterion type, the center position, in the width directions, of a medium 99 stacked on the stacked unit 30 is constant regardless of the size of the medium 99. Therefore, when the regulating unit 50 is of a center criterion type, the inclination of a medium 99 is further reduced compared to a case where the regulating unit 50 is of a one-side criterion type.

(3) The second main regulating member 52 is linked to and cooperates with the second subordinate regulating member 54. A user operates the first subordinate regulating member 53 or the second subordinate regulating member 54 to make the first main regulating member 51 and the second main regulating member 52 move. Therefore, it is easy for a user to operate the regulating unit 50, compared to a case where the regulating unit 50 does not include the second subordinate regulating member 54 and includes the first subordinate regulating member 53. In addition, when the first subordinate regulating member 53 and the second subordinate regulating member 54 sandwich a medium 99, the inclination of the medium 99 is further reduced compared to a case where only the first main regulating member 51 and the second main regulating member 52 sandwich a medium 99.

(4) The main coupled portion 56 and the subordinate coupled portion 58 are coupled together, so that the first main regulating member 51 is linked to and cooperates with the first subordinate regulating member 53. Therefore, the first main regulating member 51 and the first subordinate regulating member 53 are linked together and cooperate by a simple configuration, compared to a configuration in which the first main regulating member 51 and the first subordinate regulating member 53 are linked together and cooperate by, for example, electrical control. In addition, a similar effect is also mentioned about the second main regulating member 52 and the second subordinate regulating member 54.

(5) The main coupled portion 56 is an upstream portion, in the feed direction A1, of the first main regulating member 51. The subordinate coupled portion 58 is a downstream portion, in the feed direction A1, of the first subordinate regulating member 53. Therefore, the main coupled portion 56 and the subordinate coupled portion 58 couple the upstream end, in the feed direction A1, of the first main regulating member 51 to the downstream end, in the feed direction A1, of the first subordinate regulating member 53. As a result, the length, in the feed direction A1, of the regulating unit 50 is lengthened. Consequently, the inclination of a medium 99 is more easily reduced. In addition, a similar effect is also mentioned about the second main regulating member 52 and the second subordinate regulating member 54.

(6) The subordinate coupled portion 58 sandwiches the main coupled portion 56 in the width directions whether the cover 40 is open or closed. That is to say, the coupling of the main coupled portion 56 and the subordinate coupled portion 58 is kept whether the cover 40 is open or closed. Therefore, a user operates the first subordinate regulating member 53 to operate the first main regulating member 51 whether the cover 40 is open or closed. In addition, a similar effect is also mentioned about the second main regulating member 52 and the second subordinate regulating member 54. In addition, the subordinate coupled portion 58 is located on both sides, in the width directions, of the main coupled portion 56. Therefore, when the first subordinate regulating member 53 and the second subordinate regulating member 54 sandwich a medium 99, the subordinate coupled portions 58 touch the medium 99. Consequently, the inclination of the medium 99 is reduced.

(7) When the second stacked member 32 is pulled out from the first stacked member 31, the second stacked member 32 and the first stacked member 31 align in this order in the feed direction A1. Therefore, a user pulls out the second stacked member 32 from the first stacked member 31 to stack a medium 99 whose length in the feed direction A1 is long, on the stacked unit 30.

(8) The cover 40 includes the indicator 45 that indicates the size of a medium 99 stacked on the stacked unit 30, based on the position of the regulating unit 50. Due to the indicator 45, a user easily grasps the size of a medium 99 stacked on the stacked unit 30.

(9) The cover 40 faces the stacked surface of the stacked unit 30. Consequently, the possibility that dust adheres to the stacked surface is reduced. In addition, the possibility that dust adheres to a medium 99 stacked on the stacked unit 30 is reduced.

(10) When the second main regulating member 52 is fixed to the stacked unit 30, the regulating unit 50 regulates the position of a medium 99 in the width directions, with the second main regulating member 52 as the criterion. Consequently, the possibility that a medium 99 in an inclined state is fed is reduced.

The present embodiment can be modified to be implemented as follows. The present embodiment and the following modification can be combined together to be implemented within a range where there is no technical contradiction.

Figure 11:
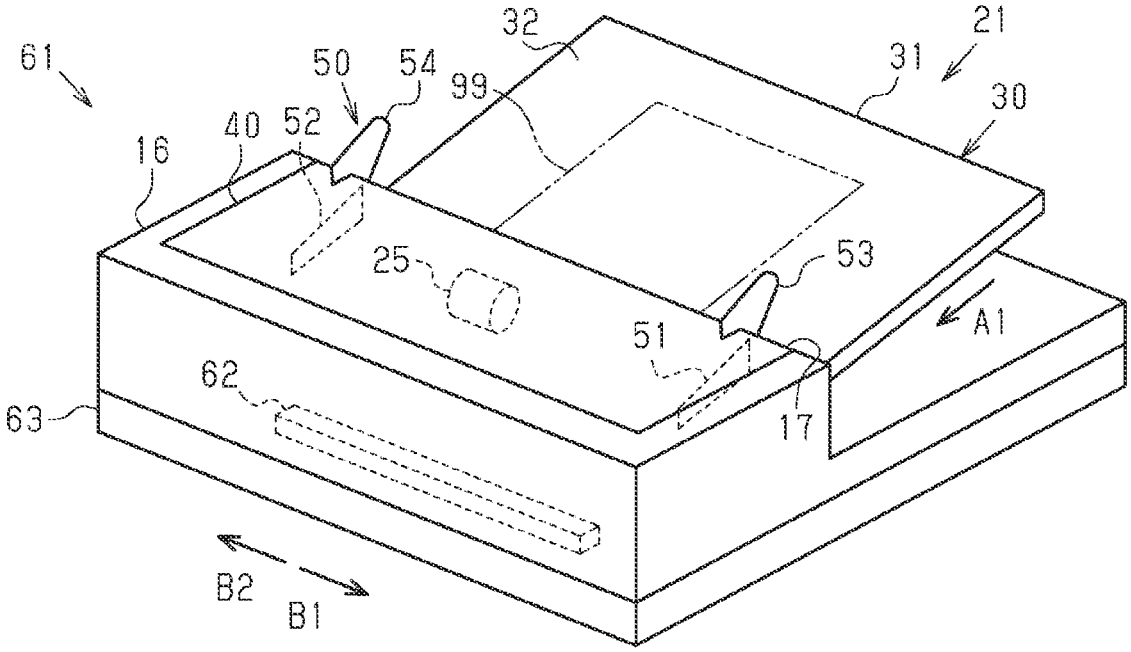
FIG. 11 is a perspective view illustrating an embodiment of an image reading apparatus including a medium feeding device.

As illustrated in FIG. 11, a reading apparatus 61 may include a medium feeding device 21. The reading apparatus 61 includes, for example, a housing 16, a reading unit 62, a reading table 63, and the medium feeding device 21.

The reading unit 62 reads an image recorded on a medium 99. The reading unit 62 reads a medium 99 fed by the medium feeding device 21. That is to say, the reading unit 62 reads an image on a medium 99 stacked on a stacked unit 30.

The reading unit 62 includes an image sensor. The reading unit 62 is located, for example, in the reading table 63. In this case, the reading unit 62 also reads a medium 99 placed on the top surface of the reading table 63. The reading unit 62 may be located in the housing 16.

The reading table 63 and the medium feeding device 21 are layered. The reading table 63 is located, for example, under the housing 16. The reading table 63 is coupled to the medium feeding device 21. The medium feeding device 21 opens and closes relative to the reading table 63. A user opens the medium feeding device 21 relative to the reading table 63 to set a medium 99 on the top surface of the reading table 63.

In this modification, the stacked unit 30 includes only a first stacked member 31 as a stacked member. The first stacked member 31 extends to pass through a feed opening 17. Part of the first stacked member 31 is located downstream of the feed opening 17. More specifically, the downstream end, in a feed direction A1, of the first stacked member 31 is located downstream of the feed opening 17.

A cover 40 is attached to the housing 16. The cover 40 opens and closes relative to the feed opening 17. A feeding unit 25 is attached to the cover 40. In this modification, the cover 40 forms the edge of the feed opening 17 when the cover 40 is closed. Therefore, when the cover 40 is closed, the cover 40 does not block the feed opening 17. When the cover 40 is closed, the cover 40 covers the downstream end, in the feed direction A1, of the first stacked member 31. When the cover 40 is open, the inside of the housing 16 is exposed. When the cover 40 opens to expose the inside of the housing 16, the downstream end, in the feed direction A1, of the first stacked member 31 is exposed.

Of a regulating unit 50, a first main regulating member 51 and a second main regulating member 52 are attached to the first stacked member 31. The first main regulating member 51 and the second main regulating member 52 are located downstream of the feed opening 17. A first subordinate regulating member 53 and a second subordinate regulating member 54 are attached to the cover 40. Therefore, a user operates the first subordinate regulating member 53 or the second subordinate regulating member 54 to operate the first main regulating member 51 and the second main regulating member 52 without opening the cover 40.

Regarding the subordinate regulating members, the regulating unit 50 may be configured not to include the second subordinate regulating member 54 but to include only the first subordinate regulating member 53. In this case, the first subordinate regulating member 53 is linked to and cooperates with the first main regulating member 51. The second main regulating member 52 is linked to and cooperates with the first main regulating member 51. Therefore, a user operates the first subordinate regulating member 53 to operate the first main regulating member 51 and the second main regulating member 52 without opening the cover 40.

In this modification, the number of the subordinate regulating members is reduced compared to the above-described embodiment. Therefore, the number of components of the medium feeding device 21 is reduced to reduce the cost of the medium feeding device 21.

The first main regulating member 51 may be linked to and cooperate with the first subordinate regulating member 53 by electrical control. For example, the medium feeding device 21 may include a sensor that detects the position of the first subordinate regulating member 53 in the width directions. In this case, based on the position of the first subordinate regulating member 53 detected by the sensor, the medium feeding device 21 moves the first main regulating member 51 with, for example, a motor. In addition, similarly, the first subordinate regulating member 53 may be linked to and cooperate with the first main regulating member 51 by electrical control. The second main regulating member 52 and the second subordinate regulating member 54 may also be linked together and cooperate by electrical control.

The main coupled portion 56 and the subordinate coupled portion 58 may be configured to be coupled together only when the cover 40 is closed. In this case, when the cover 40 is closed, a user operates the first subordinate regulating member 53 or the second subordinate regulating member 54 to operate the first main regulating member 51 and the second main regulating member 52.

The liquid ejected by the recording unit 12 is not limited to ink, and may be, for example, a liquid material in which particles of a functional material are dispersed or mixed in a liquid. For example, the recording unit 12 may eject a liquid material containing a material, such as an electrode material or a pixel material, used for manufacture of a liquid crystal display, an electroluminescence display, and a surface emission display, and the like, in a dispersed or dissolved form.

Hereinafter, technical ideas grasped from the above-described embodiment and modification, and actions and effects of the above-described embodiment and modification will be described.

(A) A medium feeding device for feeding a medium through a feed opening, the medium feeding device including: a stacked unit that extends to pass through the feed opening and on which a medium is stacked; a feeding unit that feeds a medium stacked on the stacked unit; a regulating unit that regulates a position of a medium stacked on the stacked unit, in width directions; and a cover that opens and closes relative to the feed opening, wherein the regulating unit includes a main regulating member movable in the width directions and attached to the stacked unit and a subordinate regulating member movable in the width directions and attached to the cover, a downstream end, in a feed direction, of the main regulating member is located downstream of the feed opening, and the main regulating member is linked to and cooperates with the subordinate regulating member.

According to the above-described configuration, a user moves the subordinate regulating member to move the main regulating member. That is to say, a user operates the regulating unit without opening the cover. Therefore, it is easy for a user to operate the regulating unit.

(B) In the above-described medium feeding device, the main regulating member may be a first main regulating member, the regulating unit may include a second main regulating member movable in the width directions and attached to the stacked unit, a downstream end, in the feed direction, of the second main regulating member may be located downstream of the feed opening, and the first main regulating member and the second main regulating member may be linked together and cooperate to move in the respective opposite width directions to sandwich a medium in the width directions.

According to the above-described configuration, the regulating unit regulates the position of a medium in the width directions, with the center between the first main regulating member and the second main regulating member, as the criterion. Consequently, the possibility that a medium in an inclined state is fed is reduced.

(C) In the above-described medium feeding device, the subordinate regulating member may be a first subordinate regulating member, the regulating unit may include a second subordinate regulating member movable in the width directions and attached to the cover, and the second main regulating member may be linked to and cooperate with the second subordinate regulating member.

According to the above-described configuration, the first subordinate regulating member or the second subordinate regulating member is operated to make the first main regulating member and the second main regulating member move. Therefore, it is easy for a user to operate the regulating unit, compared to a case where the regulating unit does not include the second subordinate regulating member and includes the first subordinate regulating member.

(D) In the above-described medium feeding device, the main regulating member may be a first main regulating member, the regulating unit may include a second main regulating member fixed to the stacked unit, a downstream end, in the feed direction, of the second main regulating member may be located downstream of the feed opening, and the first main regulating member moves in the width directions, so that the first main regulating member and the second main regulating member may sandwich a medium in the width directions.

According to the above-described configuration, the regulating unit regulates the position of a medium in the width directions, with the second main regulating member as the criterion. Consequently, the possibility that a medium in an inclined state is fed is reduced.

(E) In the above-described medium feeding device, the main regulating member may have a main coupled portion coupled to the subordinate regulating member, the subordinate regulating member may have a subordinate coupled portion coupled to the main regulating member, and the main coupled portion and the subordinate coupled portion are coupled together, so that the main regulating member may be linked to and cooperate with the subordinate regulating member.

According to the above-described configuration, the main regulating member and the subordinate regulating member are linked together and cooperate by a simple configuration, compared to a configuration in which the main regulating member and the subordinate regulating member are linked together and cooperate by, for example, electrical control.

(F) In the above-described medium feeding device, the main coupled portion may be an upstream portion, in the feed direction, of the main regulating member and the subordinate coupled portion may be a downstream portion, in the feed direction, of the subordinate regulating member.

According to the above-described configuration, the main coupled portion and the subordinate coupled portion couple the upstream end, in the feed direction, of the main regulating member to the downstream end, in the feed direction, of the subordinate regulating member. As a result, the length, in the feed direction, of the regulating unit is lengthened. Consequently, the inclination of a medium is more easily reduced.

(G) In the above-described medium feeding device, the subordinate coupled portion may sandwich the main coupled portion in the width directions to be coupled to the main coupled portion and may sandwich the main coupled portion in the width directions whether the cover is open or closed.

According to the above-described configuration, the coupling of the main coupled portion and the subordinate coupled portion is kept whether the cover is open or closed. Therefore, a user operates the subordinate regulating member to operate the main regulating member whether the cover is open or closed.

(H) In the above-described medium feeding device, the stacked unit may include a first stacked member and a second stacked member configured to be pulled out from the first stacked member, the main regulating member may be attached to the first stacked member, and when the second stacked member is pulled out from the first stacked member, the second stacked member and the first stacked member may align in this order in the feed direction.

According to the above-described configuration, a user pulls out the second stacked member from the first stacked member to stack a medium whose length in the feed direction is long, on the stacked unit.

(I) In the above-described medium feeding device, the cover may include an indicator that indicates a size of a medium stacked on the stacked unit, based on a position of the regulating unit.

According to the above-described configuration, due to the indicator, a user easily grasps the size of a medium stacked on the stacked unit.

(J) In the above-described medium feeding device, the stacked unit may have a stacked surface that touches a stacked medium and the cover may face the stacked surface.

According to the above-described configuration, the possibility that dust adheres to the stacked surface is reduced. In addition, the possibility that dust adheres to a medium stacked on the stacked unit is reduced.

(K) An image recording apparatus includes: the above-described medium feeding device; and a recording unit that records an image on a medium stacked on the stacked unit.

According to the above-described configuration, an effect similar to the effect of the above-described medium feeding device is obtained.

(L) The above-described image recording apparatus may further include: a housing that accommodates the recording unit, wherein the stacked unit may be configured to be accommodated in the housing.

According to the above-described configuration, the stacked unit is accommodated in the housing to reduce an installation space of the image recording apparatus when, for example, a user does not use the image recording apparatus.

(M) An image reading apparatus includes: the above-described medium feeding device; and a reading unit that reads an image on a medium stacked on the stacked unit.

According to the above-described configuration, an effect similar to the effect of the above-described medium feeding device is obtained.

What is claimed is:

1. A medium feeding device for feeding a medium through a feed opening, the medium feeding device comprising:

a stacked unit that extends to pass through the feed opening and on which a medium is stacked;

a feeding unit that feeds a medium stacked on the stacked unit;

a regulating unit that regulates a position of a medium stacked on the stacked unit, in width directions; and a cover that opens and closes relative to the feed opening, wherein the regulating unit includes a main regulating member movable in the width directions and attached to the stacked unit and a subordinate regulating member movable in the width directions and attached to the cover, a downstream end, in a feed direction, of the main regulating member is located downstream of the feed opening, the main regulating member is linked to and cooperates with the subordinate regulating member, the stacked unit has a stacked surface that touches a stacked medium, and the cover faces the stacked surface and the stacked medium on the stacked surface when the cover is closed relative to the feed opening.

2. The medium feeding device according to claim 1, wherein the main regulating member is a first main regulating member, the regulating unit includes a second main regulating member movable in the width directions and attached to the stacked unit, a downstream end, in the feed direction, of the second main regulating member is located downstream of the feed opening, and the first main regulating member and the second main regulating member are linked together and cooperate to move in the respective opposite width directions to sandwich a medium in the width directions.

3. The medium feeding device according to claim 2, wherein the subordinate regulating member is a first subordinate regulating member, the regulating unit includes a second subordinate regulating member movable in the width directions and attached to the cover, and the second main regulating member is linked to and cooperates with the second subordinate regulating member.

4. The medium feeding device according to claim 1, wherein the main regulating member is a first main regulating member, the regulating unit includes a second main regulating member fixed to the stacked unit, a downstream end, in the feed direction, of the second main regulating member is located downstream of the feed opening, and the first main regulating member moves in the width directions, so that the first main regulating member and the second main regulating member sandwich a medium in the width directions.

5. The medium feeding device according to claim 1, wherein the main regulating member has a main coupled portion coupled to the subordinate regulating member, the subordinate regulating member has a subordinate coupled portion coupled to the main regulating member, and the main coupled portion and the subordinate coupled portion are coupled together, so that the main regulating member is linked to and cooperates with the subordinate regulating member.

6. The medium feeding device according to claim 5, wherein the main coupled portion is an upstream portion, in the feed direction, of the main regulating member and the subordinate coupled portion is a downstream portion, in the feed direction, of the subordinate regulating member.

7. The medium feeding device according to claim 5, wherein the subordinate coupled portion sandwiches the main coupled portion in the width directions to be coupled to the main coupled portion and sandwiches the main coupled portion in the width directions whether the cover is open or closed.

8. The medium feeding device according to claim 5, wherein the main coupled portion sandwiches the subordinate coupled portion in the width directions to be coupled to the subordinate coupled portion and sandwiches the subordinate coupled portion in the width directions whether the cover is open or closed.

9. The medium feeding device according to claim 1, wherein the stacked unit includes a first stacked member and a second stacked member configured to be pulled out from the first stacked member, the main regulating member is attached to the first stacked member, and when the second stacked member is pulled out from the first stacked member, the second stacked member and the first stacked member align in this order in the feed direction.

10. The medium feeding device according to claim 1, wherein the cover includes an indicator that indicates a size of a medium stacked on the stacked unit, based on a position of the regulating unit.

11. An image recording apparatus comprising:

the medium feeding device according to claim 1; and a recording unit that records an image on a medium stacked on the stacked unit.

12. The image recording apparatus according to claim 11, further comprising:

a housing that accommodates the recording unit, wherein the stacked unit is configured to be accommodated in the housing.

13. An image reading apparatus comprising:

the medium feeding device according to claim 1; and a reading unit that reads an image on a medium stacked on the stacked unit.

14. The medium feeding device according to claim 1, wherein an upstream end, in the feed direction, of the main regulating member is located downstream of the cover when the cover is closed relative to the feed opening.

15. The medium feeding device according to claim 1, wherein the cover pivots away from the stacked unit as the cover opens relative to the feed opening and pivots towards the stacked unit as the cover closes relative to the feed opening.

16. A medium feeding device for feeding a medium through a feed opening, the medium feeding device comprising:

a stacked unit that extends to pass through the feed opening and on which a medium is stacked;

a feeding unit that feeds a medium stacked on the stacked unit;

a regulating unit that regulates a position of a medium stacked on the stacked unit, in width directions; and a cover that opens and closes relative to the feed opening, the regulating unit receiving a portion of the cover, the regulating unit being slidable along an outer surface and an inner surface of the cover, wherein the regulating unit includes a main regulating member movable in the width directions and attached to the stacked unit and a subordinate regulating member movable in the width directions and attached to the cover, the subordinate regulating member having a first portion that is slidable along an outer surface of the cover, the outer surface being a surface that is exposed to an outside when the cover is closed relative to the feed opening, and a second portion that is slidable along an inner surface of the cover, the inner surface being a surface is adjacent to the feed opening when the cover is closed relative to the feed opening, a downstream end, in a feed direction, of the main regulating member is located downstream of the feed opening, and the main regulating member is linked to and cooperates with the subordinate regulating member.

17. The medium feeding device according to claim 16, wherein the stacked unit has a stacked surface that touches a stacked medium and the cover faces the stacked surface.

18. A medium feeding device for feeding a medium through a feed opening, the medium feeding device comprising:

a stacked unit that extends to pass through the feed opening and on which a medium is stacked;

a feeding unit that feeds a medium stacked on the stacked unit;

a regulating unit that regulates a position of a medium stacked on the stacked unit, in width directions; and a cover that opens and closes relative to the feed opening, wherein the regulating unit includes a main regulating member movable in the width directions and attached to the stacked unit; and a subordinate regulating member movable in the width directions and attached to the cover, a downstream end, in a feed direction, of the main regulating member is located downstream of the feed opening, and the main regulating member is linked to and cooperates with the subordinate regulating member, the main regulating member is a first main regulating member, the regulating unit includes a second main regulating member movable in the width directions and attached to the stacked unit, a downstream end, in the feed direction, of the second main regulating member is located downstream of the feed opening, the first main regulating member and the second main regulating member are directly linked together by racks and a pinion and cooperate to move in the respective opposite width directions to sandwich a medium in the width directions, the subordinate regulating member is a first subordinate regulating member, the regulating unit includes a second subordinate regulating member movable in the width directions and attached to the cover, the first subordinate regulating member and the second subordinate regulating member are not directly linked together, and the second main regulating member is linked to and cooperates with the second subordinate regulating member.

19. A medium feeding device for feeding a medium through a feed opening, the medium feeding device comprising:

a stacked unit that extends to pass through the feed opening and on which a medium is stacked;

a feeding unit that feeds a medium stacked on the stacked unit;

a regulating unit that regulates a position of a medium stacked on the stacked unit, in width directions; and a cover that opens and closes relative to the feed opening, wherein the regulating unit includes a main regulating member movable in the width directions and attached to the stacked unit and a subordinate regulating member movable in the width directions and attached to the cover, a downstream end, in a feed direction, of the main regulating member is located downstream of the feed opening, the main regulating member is linked to and cooperates with the subordinate regulating member, and the medium stacked on the stacked unit is not stacked on the cover.

* * * * *